US005967610A

United States Patent [19]

Lin

[11] Patent Number: 5,967,610

[45] Date of Patent: Oct. 19, 1999

[54] CHAIR WITH SWIVEL SEAT AND BACKREST

[76] Inventor: Chen-Da Lin, P.O. Box 82-144, Taipei, Taiwan

[21] Appl. No.: 09/012,581

[22] Filed: Jan. 26, 1998

[51] Int. Cl.[6] ..... A47C 1/00

[52] U.S. Cl. ..... 297/340; 297/353; 297/183.9; 482/130; 482/142

[58] Field of Search ..... 297/340, 353, 297/383, 217.1, 183.9, 411.2, 185; 482/130, 142

[56] References Cited

U.S. PATENT DOCUMENTS

| | | | |
|---|---|---|---|
| 2,568,988 | 9/1951 | Childs | 297/353 X |
| 3,720,443 | 3/1973 | Mourgue | 297/353 X |
| 4,429,918 | 2/1984 | Alsup, Jr. et al. | 297/353 |
| 4,822,093 | 4/1989 | Kawai et al. | 297/353 X |
| 5,035,466 | 7/1991 | Mathews et al. | 297/353 X |
| 5,110,121 | 5/1992 | Foster | 482/142 X |
| 5,336,138 | 8/1994 | Arjawat | 482/130 X |
| 5,695,250 | 12/1997 | Lin | 297/340 X |
| 5,755,650 | 5/1998 | Urso | 297/183.9 X |

*Primary Examiner*—Peter M. Cuomo
*Assistant Examiner*—Rodney B. White
*Attorney, Agent, or Firm*—A & J

[57] ABSTRACT

A chair with a swivel seat and backrest includes a base support having a central portion on which is vertically mounted a hydraulic cylinder, the hydraulic cylinder having an upwardly extending piston rod, a seat having a bottom provided with a base frame, a first gear disposed under the base frame, a backrest having a lower portion provided with a support member, the supporting member having a lower end provided with a second gear meshed with the first gear, a bracket including an upper mounting and a lower mounting, the upper mounting having a top provided with two vertical bolts, one of the vertical bolts extending upwardly through the first gear to engage with the base frame, another one of the vertical bolts extending upwardly through the second gear to engage with the supporting member, the lower mounting being fixedly connected with the upper mounting having a downwardly extending tubular portion receiving the piston rod, and two armrests fixedly mounted on two opposite sides of the backrest, whereby the seat and the backrest can be rotated in opposite directions as desired thereby making it able to give exercise to an user's lumbar.

5 Claims, 6 Drawing Sheets

CHAIR WITH SWIVEL SEAT AND BACKREST

CROSS-REFERENCE

This application is related to U.S. Pat. No. 5,695,250, owned by the same inventor.

BACKGROUND OF THE INVENTION

1. Field of the Invention

This invention is related to an improved chair and in particular to one having a swivel seat and backrest.

2. Description of the Prior Art

Although the backrest of some conventional chairs is adjustable in inclination, it is still impossible to prevent for those who have to sit on a chair and work in front of a desk for a long time from feeling aching in the back and lumbar. Therefore, it is an object of the present invention to provide an improved chair which can obviate and mitigate the above-mentioned drawbacks.

SUMMARY OF THE INVENTION

This invention is related to an improved chair with a swivel seat and backrest.

It is the primary object of the present invention to provide a chair having a backrest which can be rotated with respect to a seat.

It is another object of the present invention to provide a chair with a swivel seat and backrest which can give exercise to the user's lumber.

It is still another object of the present invention to provide a chair with a swivel seat and backrest which can remedy the lumbar and back aching.

It is still another object of the present invention to provide a chair with a swivel seat and backrest which is simple in construction.

It is a further object of the present invention to provide a chair with a swivel seat and backrest which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
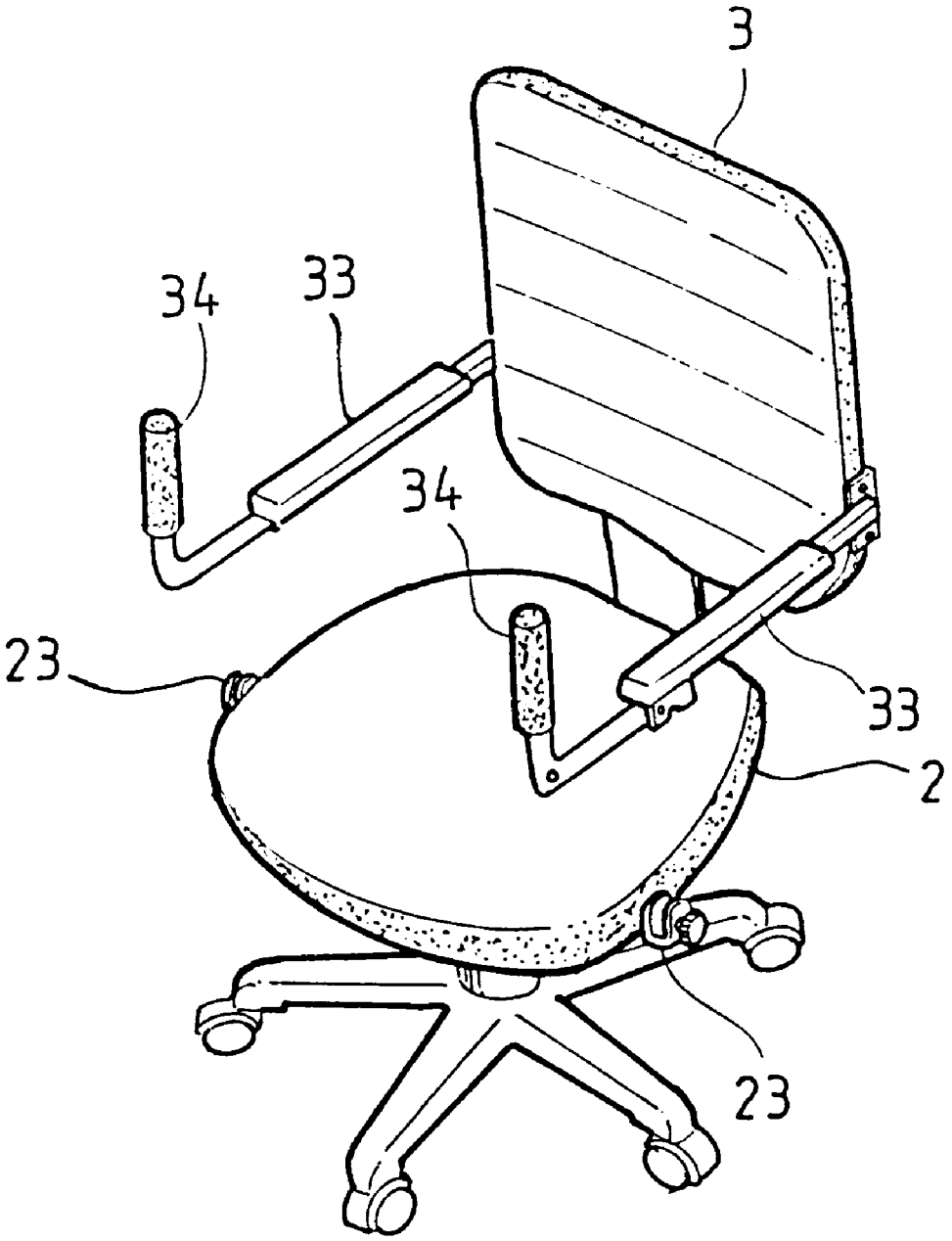
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
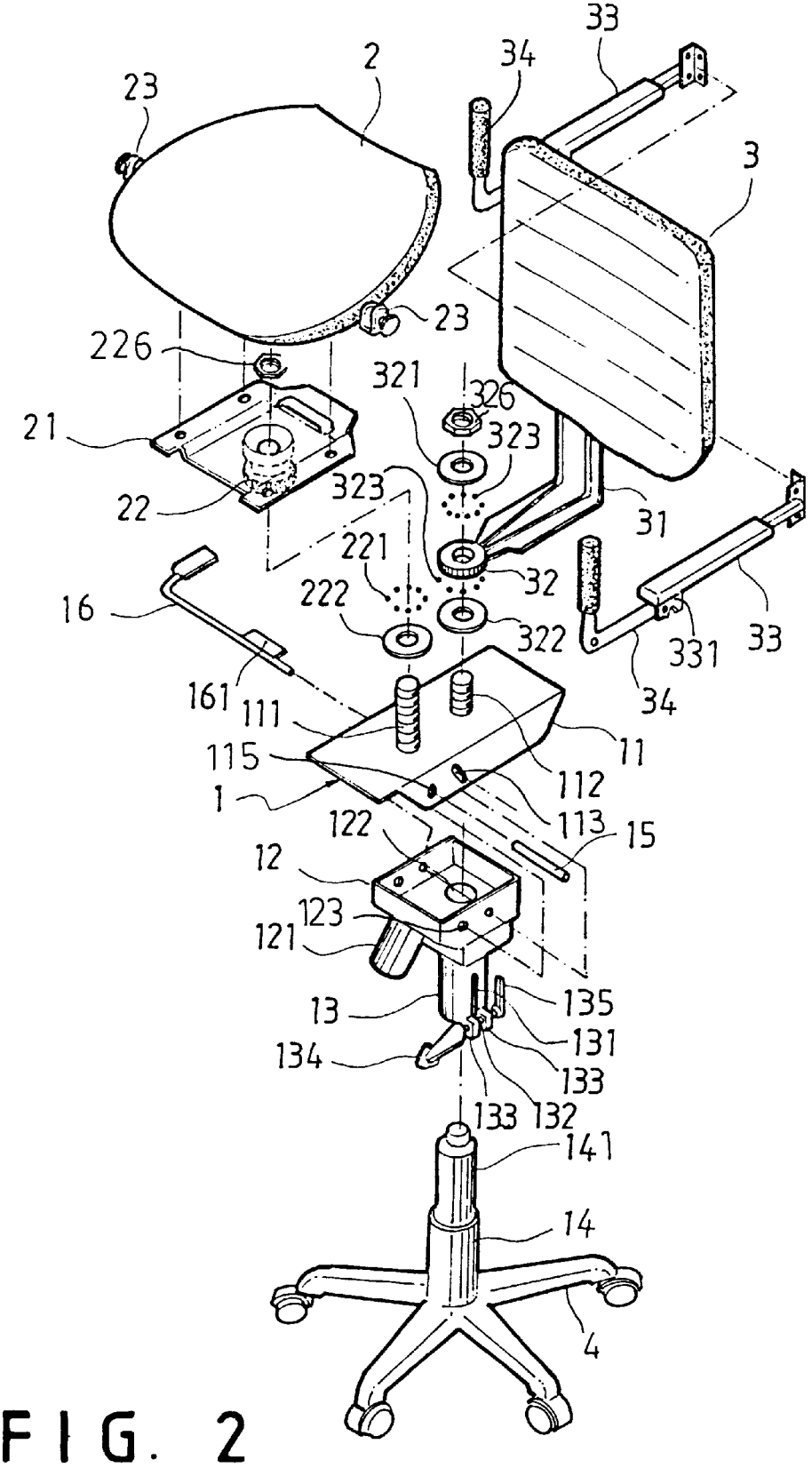
FIG. 2 is an exploded view of the present invention.

With reference to the drawings and in particular to FIGS. 1 and 2 thereof, the chair with swivel backrest according to the present invention basically comprises a bracket 1, a seat 2, a backrest 3 and a base support 4.

As shown in FIGS. 1 and 2, the bracket 1 includes an upper mounting 11 and a lower mounting 12. The upper mounting 11 is an inverted U-shaped member having a top provided with two vertical bolts 111 and 112 and two depending sides formed with a circular hole 115 and an elongated hole 113 extending therethrough. The lower mounting 12 is a rectanglar receptacle having a tubular portion 13 extending downwardly from the bottom thereof, an opening 122 communicated with the upper end of the tubular portion 13, and a spring means 121 (see FIGS. 2 and 3) slopingly mounted on the bottom thereof. Further, the lower mounting 12 has four vertical sides wherein one is formed with a first pair of holes 122 and an opposite one has a second pair of holes 123 aligned with the first pair of holes 122. The tubular portion 13 of the lower mounting 12 has a longitudinal slot 131 open at the lower end, a pair of lugs 133 at two sides of the lower end of the longitudinal slot 131, and a latch 132 extending through the lugs 133 to engage with a fixing member 135 at one end and engage with a handle 134 at another end (see FIGS. 2 and 5). A pin 15 extends through the circular hole 115 of the upper mounting 11 and the respective holes 122 and 123 of the lower mounting 12 to join the two mountings 11 and 12 together.

The base support 4 is provided with a hydraulic cylinder 14 which is vertically arranged at the central portion thereof. The hydraulic cylinder 14 has a piston rod 141 extending upwardly through the tubular portion 13 and the opening 122 into the lower mounting 12.

A control rod 16 provided with a lug 161 close to the intermediate portion extends through the elongated hole 113 of the upper mounting 11 and the respective holes 122 and 123 of the lower mounting 12, with the lug 161 contacting the upper end of the piston rod 141 of the hydraulic cylinder 14 of the base support 4, so that the position of the piston 141 can be adjusted by the control rod 16.

Figure 3:
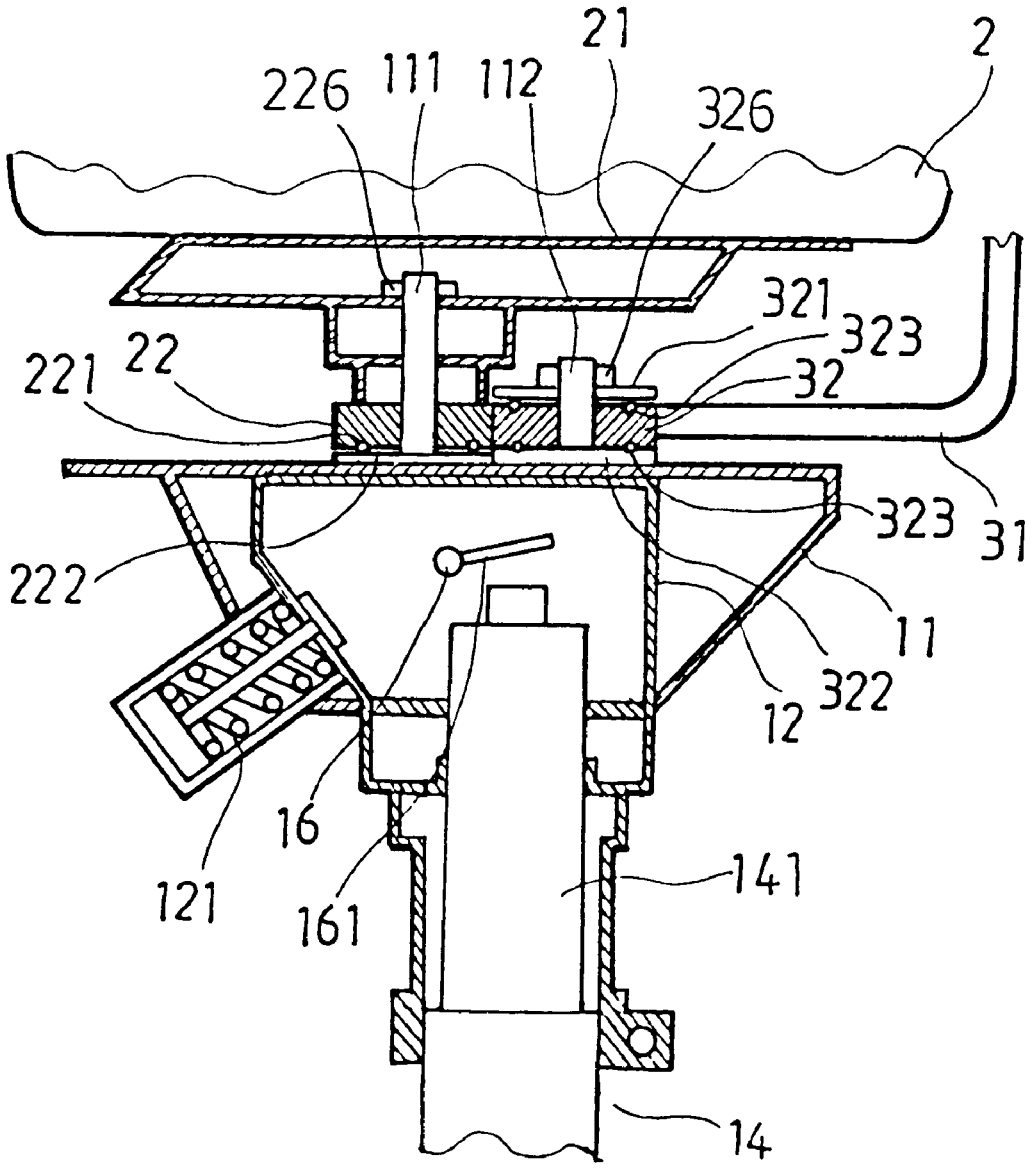
FIG. 3 is a fragmentary sectional view of the present invention.

Referring to FIGS. 2 and 3, the seat 2 is provided with a base frame 21 at the bottom under which there is a gear 22. The bolt 111 of the upper mounting 11 extends upwardly through the gear 22 into the base frame 21 to engage with a nut 226 so that the seat 2 is secured to the upper mounting 11 and the gear 22 is rotatable with respect to the bolt 111. A bearing member 222 with a plurality of balls 221 thereon is mounted under the gear 22 for smoothing the rotation thereof. Two opposite sides of the seat 2 are each provided with a U-shaped retainer 23.

Figure 4:
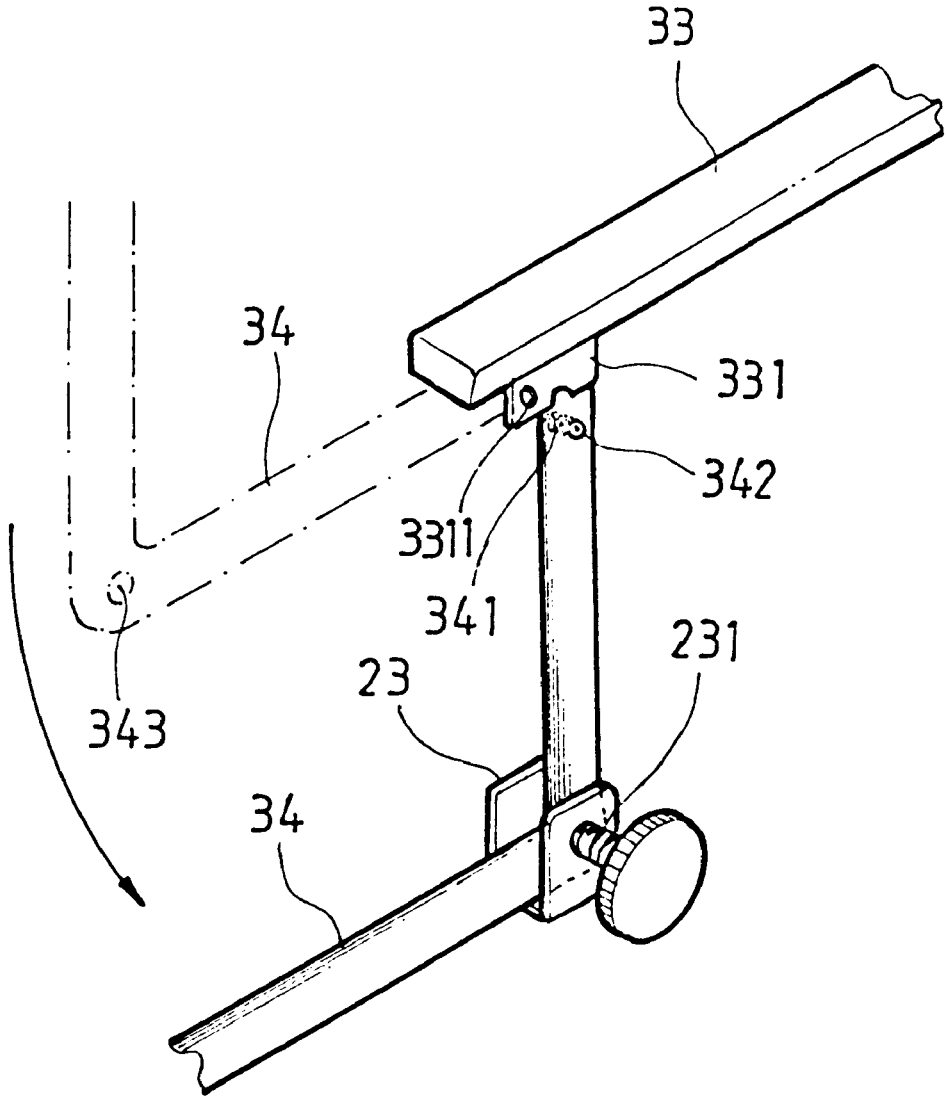
FIG. 4 illustrates how the L-shaped handle of the armrest is engaged with the U-shaped retainer of the seat.

Looking now at FIGS. 2 and 3 again, the backrest 3 has a L-shaped support 31 at the lower portion and the free end of the L-shaped support 31 is provided with a gear 32. The bolt 112 of the lower mounting 12 extends upwardly through the gear 32 to engage with a nut 326 so that the backrest 3 is fixedly installed on the upper mounting 11 and the gear 32 is rotatably mounted on the bolt 112 and meshed with the gear 22. The gear 32 is sandwiched between two bearing members 321 and 322 which are provided with balls 323, thereby enabling the two gears 22 and 32 to be rotated smoothly. Two armrests 33 are fixedly mounted on two sides of the backrest 3. The front end of the armrest 33 is provided with a lug 331 which is pivotally connected with a L-shaped handle 34 (see FIGS. 2 and 4). The lug 331 is formed with a recess 3311 while the L-shaped handle 34 has a spring-loaded means including a spring 341 and a ball 342 so that when the L-shaped handle 34 is disposed at the horizontal position, the ball 342 will go into the recess 3311 thus keeping the L-shaped handle 34 in place. As the L-shaped handle 34 is turned downwardly, the corner portion of the L-shaped handle 34 will be engaged with U-shaped retainer 23 and a screw 231 is turned through the U-shaped retainer 23 and the hole 343 in the corner portion of the L-shaped handle 34 to keep the armrest 33 in place.

When a user sitting on the seat 2 turns the handles 34 of armrests 33, the backrest 3 will be rotated thereby rotating the gear 32. As the gear 32 is turned, the gear 22 will be rotated in an opposite direction hence turning the seat 2 in an opposite direction to the backrest 3 and therefore giving exercise to the user's lumbar.

Figure 5:
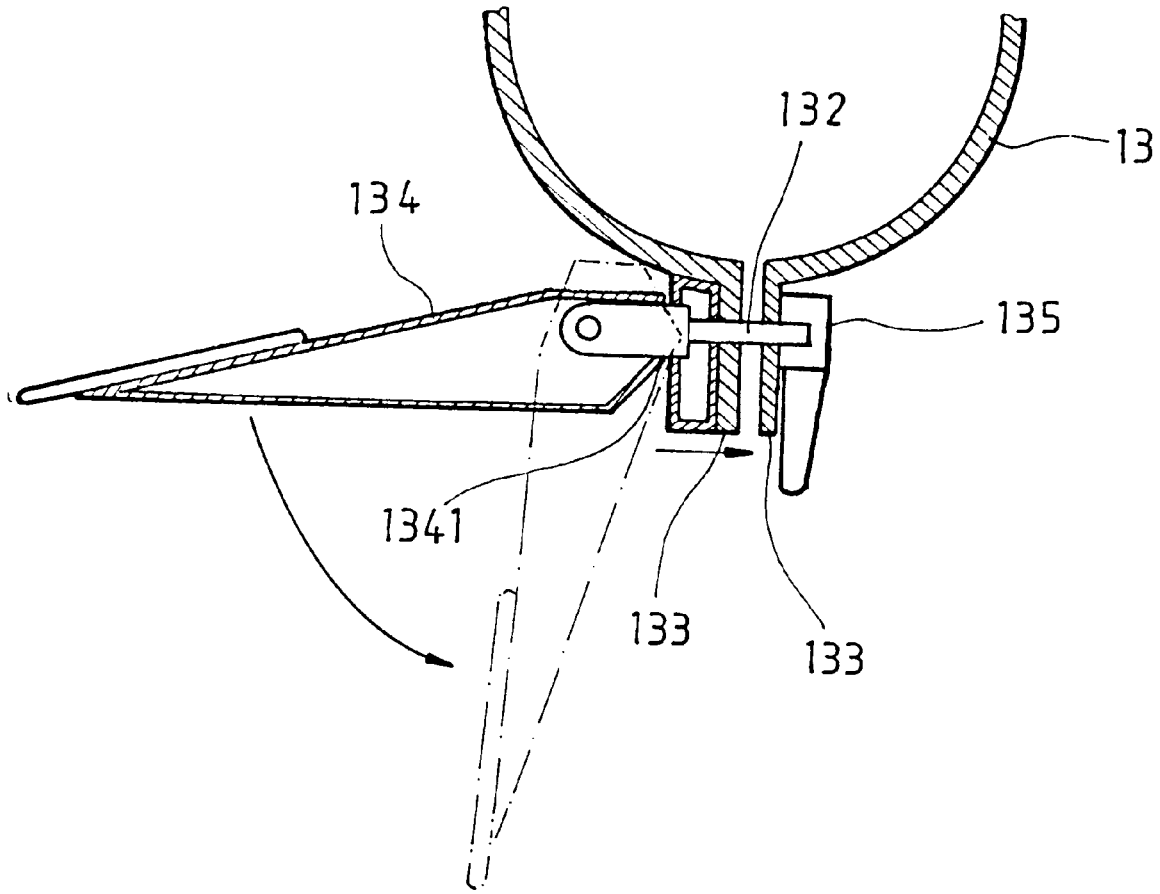
FIG. 5 is a fragmentary sectional view illustrating how to release the piston rod from the tubular portion of the lower mounting.
Figure 6A:
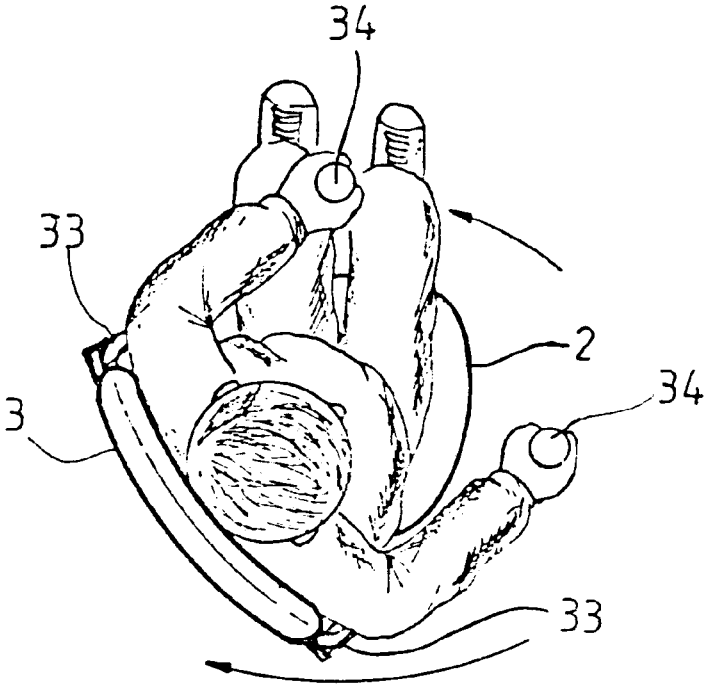
FIGS. 6A and 6B are working views of the present invention.
Figure 6B:
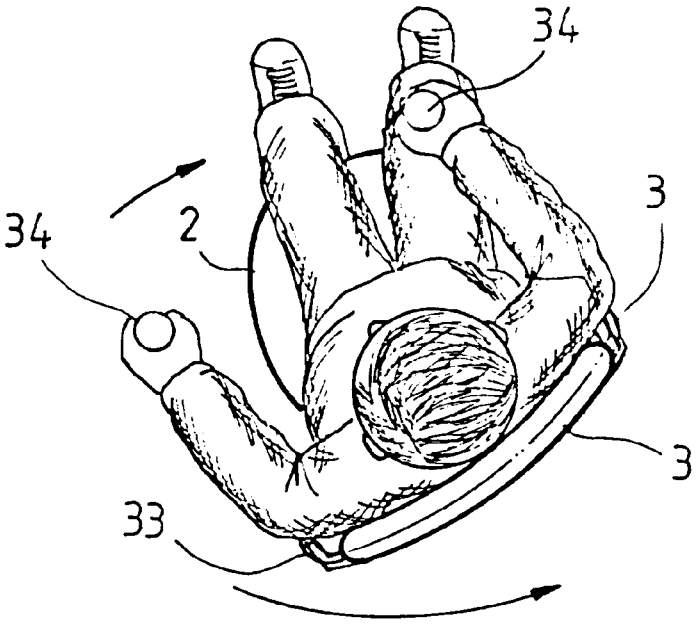

Referring to FIG. 5, when desired to use the present invention as a normal chair, it is only necessary to move the handle 134 downwardly so that the projection 1341 of the handle 134 will no longer urge against the lugs 133 of the tubular portion 13 of the lower mounting 12 so that the piston rod 141 will not rotate with the lower mounting 12 and the seat 2 and backrest 3 will be able to rotate with respect to the piston rod 141.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A chair with a swivel seat and backrest comprising:

a base support having a central portion on which is vertically mounted a hydraulic cylinder, said hydraulic cylinder having an upwardly extending piston rod;

a seat having a bottom provided with a base frame;

a first gear disposed under said base frame;

a backrest having a lower portion provided with a supporting member, said supporting member having a lower end provided with a second gear meshed with said first gear;

a bracket including an upper mounting and a lower mounting, said upper mounting having a top provided with two vertical bolts, one of said vertical bolts extending upwardly through said first gear to engage with said base frame, another one of said vertical bolts extending upwardly through said second gear to engage with said supporting member, said lower mounting being fixedly connected with said upper mounting having a downwardly extending tubular portion receiving said piston rod; and two armrests fixedly mounted on two opposite sides of said backrest;

whereby when a user sitting on said seat turns said armrests, said backrest will be rotated thereby rotating said second gear which rotates said first gear in an opposite direction and therefore turning said seat in an opposite direction to said backrest.

2. The chair with a swivel seat and backrest as claimed in claim 1, further comprising a bearing member mounted under said first gear.

3. The chair with a swivel seat and backrest as claimed in claim 1, further comprising a control rod which has a lug and extends through said bracket with said lug contacting an upper end of said piston rod to adjust position of said piston rod.

4. The chair with a swivel seat and backrest as claimed in claim 1, wherein each of said armrests has a pivotally connected handle, said chair including means to keep said handle in different positions.

5. The chair with a swivel seat and backrest as claimed in claim 1, wherein said seat is provided with two U-shaped retainers at two opposite sides adapted to receive corner portions of said armrests.

* * * * *